US009382497B2

(12) United States Patent
Furukawa et al.

(10) Patent No.: US 9,382,497 B2
(45) Date of Patent: Jul. 5, 2016

(54) LUBRICANT FOR A PLUNGER AND PRODUCTION METHOD THEREOF

(75) Inventors: Yuichi Furukawa, Toyota (JP); Hiroshi Kawai, Toyota (JP); Yasufumi Kondo, Kariya (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 101 days.

(21) Appl. No.: 14/126,623

(22) PCT Filed: Jun. 18, 2012

(86) PCT No.: PCT/IB2012/001176
§ 371 (c)(1),
(2), (4) Date: Dec. 16, 2013

(87) PCT Pub. No.: WO2013/001336
PCT Pub. Date: Jan. 3, 2013

(65) Prior Publication Data

US 2014/0106994 A1 Apr. 17, 2014

(30) Foreign Application Priority Data

Jun. 27, 2011 (JP) ..... 2011-141949

(51) Int. Cl.
*C10M 119/02* (2006.01)
*C10M 125/02* (2006.01)
(Continued)

(52) U.S. Cl.
CPC ..... *C10M 125/02* (2013.01); *C10M 169/04* (2013.01); *C10M 2201/041* (2013.01);
(Continued)

(58) Field of Classification Search
CPC ..... C10M 2201/103; C10M 2215/02; C10M 125/02; C10M 169/04; C10M 2203/1006; C10M 2201/041; C10M 2207/401; C10M 101/00; C10M 101/02; C10M 171/00; C10M 171/02; C10M 171/04; C10M 171/06; C10M 2201/00; C10M 2201/006; C10M 2201/0416; C10M 2201/10; C10M 2201/1013; C10M 2201/102; C10M 2201/1026; C10M 2201/1036; C10M 113/00; C10M 113/10; C10M 125/30; C10N 2260/09; C10N 2220/082; C10N 2240/58; C10N 2290/00; C10N 2290/02
USPC ..... 508/109, 136, 118, 131, 591
See application file for complete search history.

(56) References Cited

U.S. PATENT DOCUMENTS 2,711,394 A 6/1955 Veatch et al.
3,753,906 A * 8/1973 Burton ..... 508/143
(Continued)

FOREIGN PATENT DOCUMENTS

CN 101712904 A 5/2010
DE 28 14 366 A1 10/1979
(Continued)

OTHER PUBLICATIONS

International Search Report for corresponding International Patent Application No. PCT/IB2012/001176 mailed Nov. 7, 2012.
(Continued)

*Primary Examiner* — Pamela H Weiss
(74) *Attorney, Agent, or Firm* — Sughrue Mion, PLLC

(57) ABSTRACT

An oil-based graphite lubricant for a plunger includes graphite that is used as a solid lubricant, and an organic bentonite swollen by a mineral oil and a surfactant that are used as a graphite dispersant. The lubricant is prepared by a method which includes a first step of causing an organic bentonite to swell in the mineral oil, a second step of adding a surfactant, and a third step of adding and dispersing graphite.

15 Claims, 4 Drawing Sheets

(51) Int. Cl.

| | |
|---|---|
| ***C10M 113/02*** | (2006.01) |
| ***C10M 113/10*** | (2006.01) |
| ***C10M 125/30*** | (2006.01) |
| ***C10M 137/08*** | (2006.01) |
| ***C10M 101/00*** | (2006.01) |
| ***C10M 169/04*** | (2006.01) |

(52) U.S. Cl.
CPC . *C10M2201/103* (2013.01); *C10M 2203/1006* (2013.01); *C10M 2207/401* (2013.01); *C10N 2220/082* (2013.01); *C10N 2240/58* (2013.01)

(56) References Cited

U.S. PATENT DOCUMENTS

| | | | | |
|---|---|---|---|---|
| 3,933,657 | A * | 1/1976 | Seni et al. | 508/131 |
| 6,335,309 | B1 * | 1/2002 | Takagi et al. | 508/115 |
| 2003/0220205 | A1 * | 11/2003 | Manka et al. | 508/154 |
| 2007/0138053 | A1 * | 6/2007 | Baillargeon | 208/19 |
| 2008/0219610 | A1 * | 9/2008 | Nakatani et al. | 384/462 |
| 2009/0088354 | A1 * | 4/2009 | Berry et al. | 508/388 |
| 2011/0136709 | A1 * | 6/2011 | Tanaka et al. | 508/144 |

FOREIGN PATENT DOCUMENTS

| | | | |
|---|---|---|---|
| JP | 05-007978 | A | 1/1993 |
| JP | 05117684 | A | 5/1993 |
| JP | 11-244992 | A | 9/1999 |
| JP | 2000-033457 | A | 2/2000 |
| JP | 2002-282997 | A | 10/2002 |
| JP | 2003-164956 | A | 6/2003 |
| JP | 2004256630 | A | 9/2004 |
| WO | 98/38267 | A2 | 9/1998 |

OTHER PUBLICATIONS

English Translation of Text of the First Office Action, dated May 9, 2014, issued by the State Intellectual Property Office of the People's Republic of China, in counterpart Application No. 201280021131.7.

"Handbook of the Fine Chemical Raw Materials and Intermediates—Adhesives", Chemical Industry Press, May 2005, the 1st edition, pp. 1169 to 1170, 4 pages total.

* cited by examiner

CONVENTIONAL OIL-BASED GRAPHITE LUBRICANT

OIL-BASED GRAPHITE LUBRICANT ACCORDING TO WORKING EXAMPLE

LUBRICANT FOR A PLUNGER AND PRODUCTION METHOD THEREOF

BACKGROUND OF THE INVENTION

1. Field of the Invention

The invention relates to a novel oil-based graphite lubricant for the plunger of a die-casting machine. The invention further relates to a production method of such a lubricant.

2. Description of Related Art

A lubricant is used to suitably lubricate the sliding surfaces between the shot sleeve and the plunger tip on the plunger in a die-casting machine. Plunger lubricants exist in a variety of types, including oil-based lubricants, water-soluble lubricants, and water-in-oil (w/o) emulsion-type lubricants. Of these, oil-based graphite lubricants obtained by compounding graphite in a base oil are widely used, both because of their high lubricating ability and because they can easily form a uniform film on metal surfaces. However, conventional oil-based graphite lubricants have certain drawbacks. For example, the graphite contained within the lubricant tends to aggregate and settle out during storage, resulting in variable lubricity, in addition to which the oil that rises to the top thermally decomposes and gasifies. Re-dispersing the graphite that has aggregated and settled out requires extensive stirring in a ball mill or the like.

In the field of casting, graphite-containing release agents are disclosed in, for example, Japanese Patent Application Publication No. 5-7978 (JP-5-7978 A), Japanese Patent Application Publication No. 2000-33457 (JP-2000-33457 A) and Japanese Patent Application Publication No. 11-244992 (JP-11-244992 A). In JP-5-7978 A, an aromatic surfactant is used to ensure the dispersibility of the graphite powder. In JP-2000-33457 A, a solid lubricant (graphite, etc.) in powdered form is given a small particle size and thereby rendered into a uniformly dispersed state within a liquid. JP-11-244992 A discloses the mixture of sooty graphite with a sol-like binder obtained by dispersing a feathery heat-resistant inorganic hydrate in water.

However, even when referring to JP-5-7978 A, JP-2000-33457 A and JP-11-244992 A, producing a release agent containing stably dispersed graphite which does not aggregate and settle out is a challenge. Moreover, because these literature references describe release agents, it is not obvious whether the disclosures made in these references are in any way applicable to a plunger lubricant, for which different properties are required.

SUMMARY OF THE INVENTION

It is therefore an object of this invention to provide an oil-based graphite lubricant for a plunger in a die-casting machine, which lubricant has an excellent graphite dispersion stability. Another object of the invention is to provide a method of producing such a lubricant.

The inventors have discovered that an oil-based graphite lubricant in which graphite is stably and finely dispersed and which is suitable for plunger lubrication can be obtained by using as the graphite dispersant both a surfactant and also a mineral oil-swollen organic bentonite.

According to a first aspect, the invention provides an oil-based graphite lubricant for a plunger, wherein the lubricant includes graphite that is used as a solid lubricant, and an organic bentonite swollen by a mineral oil and a surfactant that are used as a graphite dispersant.

The organic bentonite may be a bentonite in which pre-existing cations have been replaced with quaternary ammonium ions. The graphite may be an amorphous graphite having an average particle size of from 3 to 7 μm. The graphite content may be from 10 to 20 wt %.

According to a second aspect, the invention also provides a production method of an oil-based graphite lubricant for a plunger, wherein the method includes: causing an organic bentonite to swell in a mineral oil; adding a surfactant to the mineral oil, and; adding and dispersing graphite in the mineral oil.

This production method further includes, following addition of the surfactant to the mineral oil, adding a vegetable oil to the mineral oil and adding and dispersing graphite in the mineral oil. The organic bentonite may be obtained by reacting bentonite with a quaternary ammonium salt. The graphite may be an amorphous graphite having an average particle size of from 3 to 7 μm.

In the oil-based graphite lubricant for a plunger of the invention, owing to synergism between the organic bentonite swollen by the mineral oil and the surfactant, the graphite serving as the solid lubricant is stably and uniformly dispersed, as a result of which the lubricant exhibits an excellent lubricating ability.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
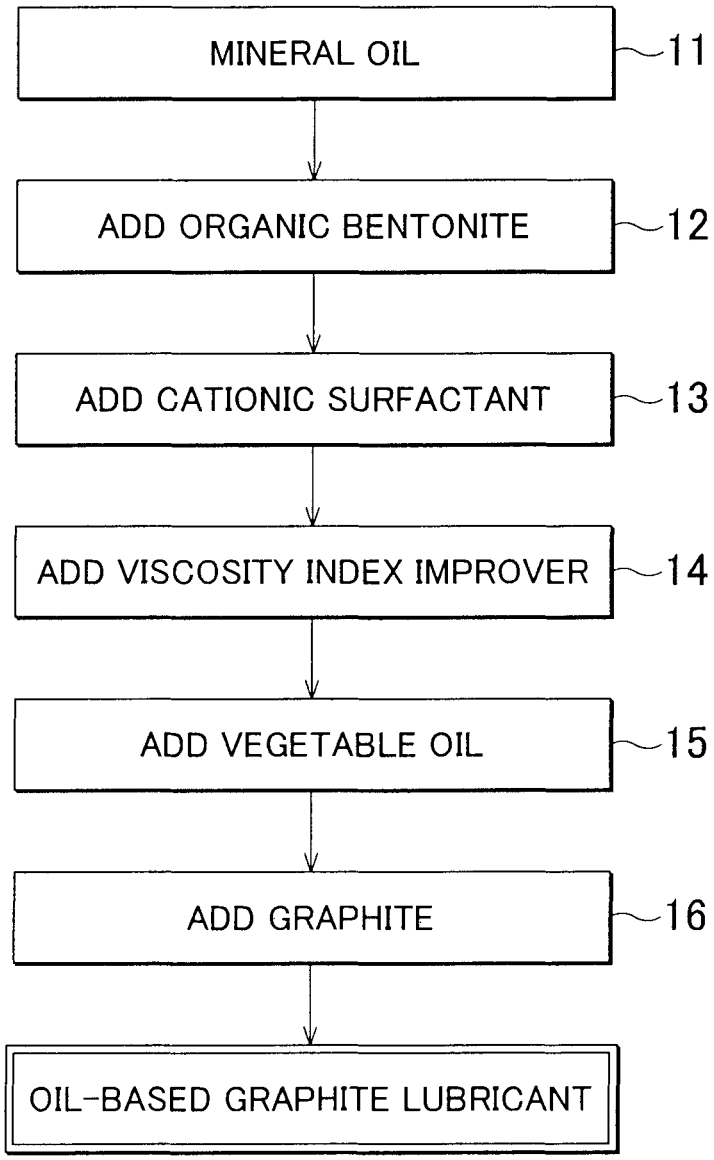
FIG. 1 is a flow diagram illustrating the production procedure for the oil-based graphite plunger lubricant according to an embodiment.

The oil-based graphite lubricant for a plunger of the embodiment is characterized by including as the graphite dispersant both a mineral oil-swollen organic bentonite and a surfactant.

Bentonite is a mineral composed primarily of montmorillonite having a layered structure of stacked lamellar crystals of aluminosilicates. Cations such as sodium and calcium ions are present between the layers of montmorillonite. Bentonite swells in the presence of water due to hydration of the interlayer cations. Bentonite generally swells only in the presence of water or a very limited number of organic solvents. However, by reacting bentonite with organic cations such as alkyl ammonium ions, due to, for example, ion exchange between interlayer cations (e.g., sodium, calcium) and the organic cations, bentonite which swells in the presence of a low-polarity organic solvent can be prepared. In this specification, "organic bentonite" refers to a modified bentonite which is obtained by reacting bentonite with organic cations and which is capable of swelling in the presence of a low-polarity organic solvent.

The compound which is reacted with bentonite in order to prepare organic bentonite is exemplified by quaternary ammonium salts and pyridinium salts. The organic bentonite used in the lubricant of the embodiment depends also on the properties of the mineral oil which is used to induce swelling, although one obtained by reacting bentonite with a quaternary ammonium salt is preferred.

The quaternary ammonium salt is exemplified by salts having a cation of the general formula

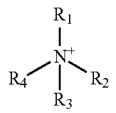

(wherein $R_1$ to $R_4$ are each independently selected from among hydrocarbon groups having from 1 to 20 carbons, such as $C_{1-20}$ alkyls and $C_{7-20}$ aralkyls (e.g., benzyl)), such as tetramethylammonium salts, tetraethylammonium salts, tetrapropylammonium salts, tetrabutylammonium salts, tetrapentylammonium salts, dodecyltrimethylammonium salts, hexadecyltrimethylammonium salts, triethylmethylammonium salts, dimethyldistearylammonium salts, dodecyldimethylbenzylammonium salts and stearyldimethylbenzylammonium salts. Quaternary ammonium salts also encompass polymeric ammonium salts having a quaternary nitrogen cation, such as polyalkyleneimines and polyallylamines.

Illustrative examples of pyridinium salts include isopropylpyridinium salts, butylpyridinium salts, heptylpyridinium salts, decylpyridinium salts, dodecylpyridinium salts and cetylpyridinium salts.

The anion of the quaternary ammonium salt or the pyridinium salt is exemplified by halide ions (particularly the chloride ion, bromide ion, and iodide ion), the hexafluorophosphoric acid ion, and the ions of carboxylic acids such as acetic acid or benzoic acid.

The content of organic bentonite in the inventive lubricant is preferably from 1.0 to 3.0 wt %, and more preferably from 1.5 to 2.5 wt %. At an amount in this range, adequate function as a graphite dispersant can be achieved without affecting the lubricating ability of the. lubricant.

The organic bentonite is used after being caused to swell in a mineral oil. The mineral oil used for swelling of the organic bentonite makes up at least some of the base oil of the lubricant. The mineral oil also functions as a liquid lubricant, lowering the sliding resistance in the low-temperature region. In this specification, "mineral oil" refers to a non-volatile hydrocarbon solvent obtained by refining petroleum. Preferred use may be made of paraffinic mineral oils, particularly low-viscosity paraffinic mineral oils, as the mineral oil. A mineral oil having a kinematic viscosity at 100° C. of from 14.5 to 18.5 $mm^2/s$ and a density at 15° C. of not more than 0.900 $g/cm^3$ is especially preferred. The content of mineral oil-containing base oil in the lubricant of the embodiment is preferably from 65 to 85 wt %, and more preferably from 70 to 80 wt %.

The surfactant which is employed together with organic bentonite as the graphite dispersant may be of one type used alone or may be of two or more types used in admixture. The use of a cationic surfactant as the surfactant is especially preferred because a cationic surfactant induces static repulsion between particles of the dispersed graphite, making it possible to prevent aggregation. Any conventional cationic surfactant may be used. Illustrative examples of suitable cationic surfactants include quaternary ammonium salts such as alkyltrimethylammonium salts, dialkyldimethylammonium salts and alkylbenzyldimethylammonium salts, and amine salts such as triethanolamine salts. The surfactant content in the lubricant of the invention is preferably from 0.1 to 1.0 wt %, and more preferably from 0.3 to 0.7 wt %.

The graphite included in the lubricant of the invention serves to, as a solid lubricant, reduce sliding friction in high-temperature regions. The graphite used may be a natural graphite such as flake graphite or amorphous graphite, or may be artificial graphite. However, taking into overall account the ease of use during preparation of the lubricant, lubricating ability and cost, amorphous graphite provides the best balance as the graphite used in this aspect of the embodiment, and is thus preferred. The graphite has an average particle size of preferably from 3 to 7 μm, and more preferably from 4 to 6 μm.

The graphite content in the lubricant of the embodiment is preferably from 10 to 20 wt %, and more preferably from 10 to 18 wt %. At a graphite content in this range, a good balance is achieved between the viscosity of the lubricant, the lubricating ability and the amount of gas evolution at the time of use.

In addition to the respective ingredients described above, the lubricant of the embodiment may include other ingredients as well. Examples of such ingredients include a viscosity index improver, a vegetable oil, and a polar aprotic organic solvent.

In addition to its essential effect of suppressing changes in viscosity associated with temperature change, a viscosity index improver also helps prevent graphite from settling in the lubricant and promotes stable dispersion of the graphite in the oil. Illustrative examples of viscosity index improvers include polymers such as polyalkyl methacrylate, polyisobutylene, polypropylene and ethylene-propylene copolymers. These may be used singly or as mixtures of two or more thereof. It is especially preferable for the viscosity index improver to have a kinematic viscosity at 100° C. of from 1,000 to 1,400 $mm^2/s$. The content of the viscosity index improver in the inventive lubricant is set to preferably from 3 to 7 wt %, and more preferably from 4 to 6 wt %.

The vegetable oil makes up, together with the mineral oil, the base oil. As a liquid lubricant, it serves to reduce friction under extreme pressure and also to lower sliding resistance in the low-temperature region. Illustrative examples of vegetable oils include rapeseed oil, soybean oil, sunflower oil, corn oil, safflower oil, cottonseed oil, sesame oil, peanut oil, linseed oil, jojoba oil, olive oil and coconut oil. Any one of these may be used singly or two or more may be used in admixture. From the standpoint of lubricating ability, viscosity, ready availability and the like, the use of rapeseed oil or soybean oil is preferred. It is especially preferable for the vegetable oil to have an acid value of at least 1.5 and a kinematic viscosity at 40° C. of from 33 to 39 $mm^2/s$. It is preferable for the content of vegetable oil in the base oil to be set to from 40 to 55 wt %, and especially from 45 to 50 wt %.

The polar aprotic organic solvent serves to assist swelling of the organic bentonite under the influence of the mineral oil and dispersion within the mineral oil. Illustrative examples of the polar aprotic organic solvent include propylene carbonate, acetone, methyl ethyl ketone, methyl isobutyl ketone, ethyl acetate, methanol, ethanol, n-propanol, isopropanol and butanol. An one of these may be used singly or two or more may be used in admixture. Of these, propylene carbonate is preferred. The content of polar aprotic organic solvent in the lubricant of the embodiment is preferably from 0.5 to 1.5 wt %.

FIG. 1 is a flow diagram illustrating the production procedure for the oil-based graphite plunger lubricant of the embodiment. The production procedure is described below in accordance with this flow sequence.

First, a mineral oil is placed in a mixing tank (S11), following which an organic bentonite is added and the tank contents are uniformly stirred under heating (S12). This operation causes the organic bentonite to swell under the influence of the mineral oil. A polar aprotic organic solvent to promote swelling of the organic bentonite may optionally be added at this point.

Next, a cationic surfactant is added to the mixing tank under heating and stirring (S13). If necessary, a viscosity index improver is also added (S14). The organic bentonite is thoroughly dispersed in the mineral oil by stirring under applied heat for a fixed period of time, such as 30 minutes or more, and especially 45 minutes or more. Alternatively, the cationic surfactant and the viscosity index improver may be added in the reverse sequence or may be added at the same time.

In cases where a vegetable oil is added (S15), addition of the vegetable oil following addition of the cationic surfactant and the viscosity index improver is preferred for the following reason. The organic bentonite which swells in the presence of the mineral oil may have more difficulty swelling due to the influence of the vegetable oil. Hence, mixing the vegetable oil in first may hinder dispersion of the organic bentonite.

Last of all, the graphite is added (S16). Rather than adding the graphite all at once, it is preferable to add the graphite over a given period of time, such as about 30 minutes. Following addition of the graphite, in order to have the graphite blend smoothly with the other ingredients, stirring for at least 24 hours under applied heat is preferred.

The inventive lubricant thus obtained preferably has an absolute viscosity (25±5° C., spindle. #4, 60 rpm), as measured with a Brookfield viscometer, of from 1.0 to 2.0 Pa·s. Moreover, in the inventive lubricant, the proportion of oil that rises to the top (supernatant) when the lubricant is centrifuged 60 minutes at 3,800 rpm is preferably not more than 1 vol %, and more preferably not more than 0.5 vol %.

WORKING EXAMPLES

The invention is illustrated more fully below by way of working examples, although the examples are not intended to limit the invention.

1. Preparation of Lubricant

A mixing tank was charged with 40.0 wt % of a mineral oil (HH900NT, from Hokoku Oil Co., Ltd.), following which 1.0 wt % of propylene carbonate and 2.0 wt % of organic bentonite (bentonite modified with quaternary ammonium cations (S-BEN N-400, from Hojun Co., Ltd.) were added and the tank contents were stirred. This was heated to between 80 and 120° C., 0.5 wt % of a cationic surfactant (Arquad 2HP Flake, from Lion Corporation) was added, and 30 to 60 minutes of additional stirring was carried out at 120±5° C. While maintaining the temperature, 5.0 wt % of a viscosity index improver (Aclube 964, from Sanyo Chemical Industries, Ltd.) and 36.5 wt % of rapeseed oil (Natane No. 2B, from Toei Chemical Co., Ltd.) were added, and finally 15.0 wt % of amorphous graphite (average particle size, 5±2 μm) was gradually added under stirring. After mixture was completed, the tank contents were allowed to cool to room temperature under stirring. The resulting lubricant had an absolute viscosity, as measured with a Brookfield viscometer in accordance with JIS K 7117-1 (25±5° C., spindle #4, 60 rpm), of 1.5±0.5 Pa·s.

2. Evaluation of Lubricant Stability (1) Evaluation by Centrifugal Separation

When the lubricant prepared above was centrifuged for 60 minutes at 3,800 rpm, from 0 to 0.5 vol % of oil supernatant formed. When a lubricant prepared in the same way as described above, aside from not using an organic bentonite, was centrifuged under the same conditions, from 4 to 5 vol % of oil supernatant formed. When a lubricant prepared in the same way as describe above, aside from not using a nonionic surfactant, was centrifuged under the same conditions, from 2 to 3 vol % of oil supernatant formed.

(2) Evaluation with Electron Microscope

Figure 2:
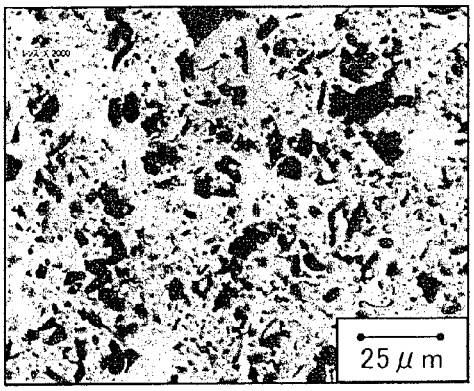
FIG. 2 presents electron micrographs showing the state of graphite dispersion in a conventional oil-based graphite lubricant and in an oil-based graphite lubricant according to the embodiment.
Figure 2:
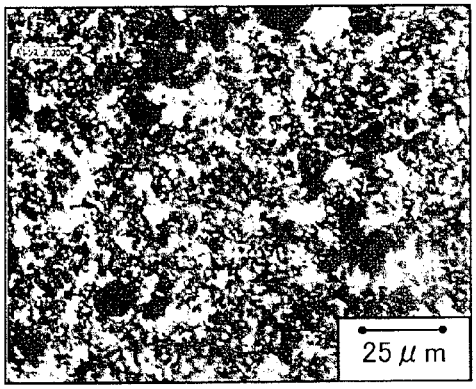

The lubricant prepared above was examined under an electron microscope, and the graphite dispersion state was compared with that in a conventional oil-based graphite lubricant prepared without using bentonite. Electron micrographs of each are shown in FIG. 2. In the electron micrographs, areas that appear white are oil ingredients, and areas that appear black are graphite. The conventional oil-based graphite lubricant appeared whitish overall, with the graphite being present in an agglomerated, insufficiently dispersed state. On the other hand, the lubricant of the working example appeared blackish overall, with the graphite being present in a very finely dispersed state.

3. Evaluation of Lubricant Performance

The effect of the lubricant on the plunger injection force was evaluated by measuring the axial force of the plunger rod at the time of injection (axial injection force). Foil strain gauges were attached to the outer periphery of the plunger at four points (top, bottom, left and right), the amount of strain ($\epsilon$) during injection was measured, and the axial force F was determined based on the following formula.

$$\sigma=\epsilon E\sigma\times A=F$$

where $\sigma$ is the stress, E is Young's modulus, A is the cross-sectional area of the object being measured, and F is the axial force. Because E and A are characteristic values, F can be determined from $\epsilon$.

Figure 3:
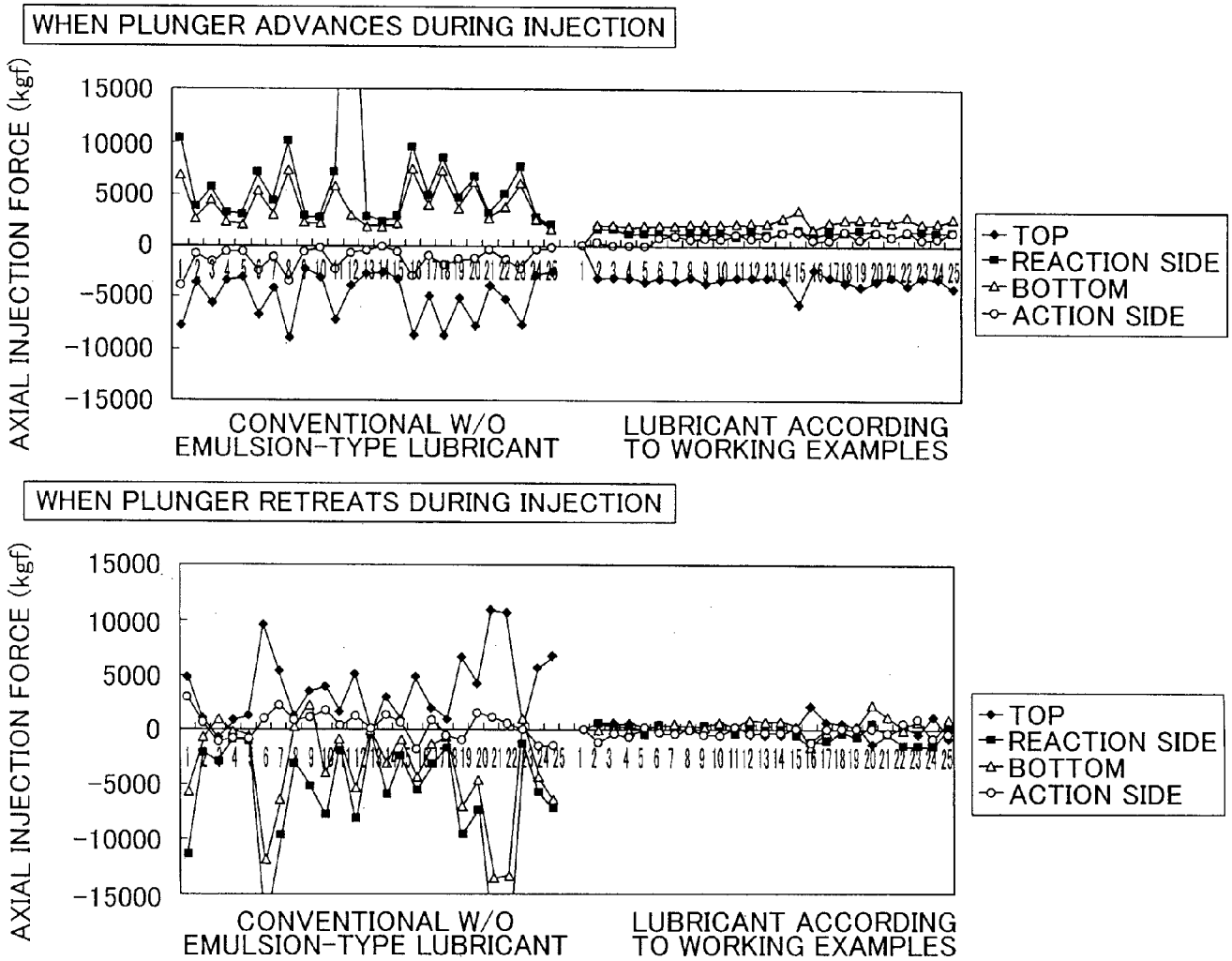
FIG. 3 shows the results of axial injection force measurements over the course of 25 consecutive shots in a large (1,650 metric ton) die-casting machine using a conventional w/o emulsion-type lubricant and using a lubricant prepared in a working example.

FIG. 3 shows the results of axial injection force measurements over the course of 25 consecutive shots in a large (1,650 metric ton) die-casting machine using a conventional w/o emulsion-type lubricant and using the lubricant prepared above in "1. Preparation of Lubricant." When the lubricant of the working example was used, the axial force was lower than when the conventional lubricant was used and there was less variability in the axial force.

Figure 4:
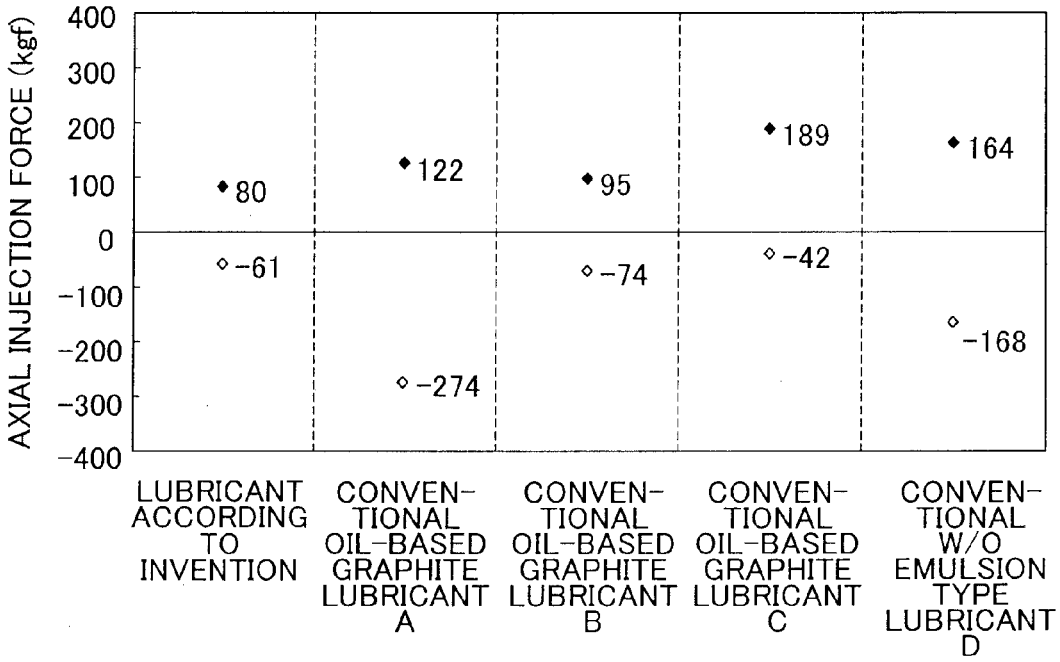
FIG. 4 shows the results of axial injection force measurements in a small (135 metric ton) die-casting machine using various types of conventional lubricants and using a lubricant prepared in a working example.

FIG. 4 shows the results of axial injection force measurements in a small (135 metric ton) die-casting machine using various types of conventional lubricants and using the lubricant prepared above in "1. Preparation of Lubricant" (each of the results shown in FIG. 4 is an average value for 20 shots). All of the conventional lubricants were prepared without using bentonite. In FIG. 4, the lubricant labeled as "conventional oil-based graphite lubricant A" was the same lubricant as that shown in the electron micrograph in FIG. 2. When the lubricant of the working example was used, the axial injection force was smaller than when any of the conventional lubricants was used.

Judging from the above results, the oil-based graphite lubricant of this working example not only had an excellent graphite dispersion stability, it also had an excellent lubricating ability. Thereby the service lives of the plunger tip and the sleeve can be extended and the quality of the die-cast products improved.

The invention claimed is:

1. An oil-based graphite lubricant for a plunger, comprising:

a mineral oil;

graphite;

an organic bentonite, the organic bentonite comprising a portion of the mineral oil;

a surfactant; and a viscosity index improver, wherein the surfactant is a cationic surfactant, the viscosity index improver has a kinematic viscosity at 100° C. of from 1,000 to 1,400 $mm^2/s$, and a viscosity index improver content in the oil-based graphite lubricant is from 3 to 7 wt %.

2. The oil-based graphite lubricant according to claim 1, wherein the organic bentonite is a bentonite in which cations in the bentonite have been replaced with quaternary ammonium ions.

3. The oil-based graphite lubricant according to claim 1, wherein the graphite is an amorphous graphite having an average particle size of from 3 to 7 μm.

4. The oil-based graphite lubricant according to claim 1, wherein a graphite content is from 10 to 20 wt %.

5. The oil-based graphite lubricant according to claim 1, wherein an organic bentonite content in the oil-based graphite lubricant is from 1.0 to 3.0 wt %.

6. The oil-based graphite lubricant according to claim 5, wherein the organic bentonite content in the oil-based graphite lubricant is from 1.5 to 2.5 wt %.

7. The oil-based graphite lubricant according to claim 1, wherein the mineral oil has a kinematic viscosity at 100° C. of from 14.5 to 18.5 $mm^2/s$ and has a density at 15° C. of less than or equal to 0.900 $g/cm^3$.

8. The oil-based graphite lubricant according to claim 1, wherein a mineral oil content in the oil-based graphite lubricant is from 65 to 85 wt %.

9. The oil-based graphite lubricant according to claim 8, wherein the the mineral oil content in the oil-based graphite lubricant is from 70 to 80 wt %.

10. The oil-based graphite lubricant according to claim 1, wherein a surfactant content in the oil-based graphite lubricant is from 0.1 to 1.0 wt %.

11. The oil-based graphite lubricant according to claim 10, wherein the surfactant content in the oil-based graphite lubricant is from 0.3 to 0.7 wt %.

12. The oil-based graphite lubricant according to claim 1, wherein the surfactant is selected from the group consisting of a quaternary ammonium salt and an amine salts.

13. The oil-based graphite lubricant according to claim 1, wherein the surfactant is a quaternary ammonium salt.

14. The oil-based graphite lubricant according to claim 1, wherein the surfactant is an amine salt.

15. The oil-based graphite lubricant according to claim 1, wherein the surfactant is selected from the group consisting of alkyltrimethylammonium salts, dialkyldimethylammonium salts, alkylbenzyldimethylammonium salts, and triethanolamine salts.

* * * * *